US010640359B1

(12) United States Patent
Laible

(10) Patent No.: US 10,640,359 B1
(45) Date of Patent: May 5, 2020

(54) CONTAINER INSERT FOR USE WITH A CLOSED LOOP DISPENSING SYSTEM

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 16/742,395

(22) Filed: Jan. 14, 2020

(51) Int. Cl.
*B67D 7/02* (2010.01)
*B65D 47/06* (2006.01)
*B65D 47/32* (2006.01)
*B65D 51/16* (2006.01)

(52) U.S. Cl.
CPC ..... *B67D 7/0294* (2013.01); *B65D 47/06* (2013.01); *B65D 47/32* (2013.01); *B65D 51/16* (2013.01)

(58) Field of Classification Search
CPC .... B67D 7/0294; B67D 7/0277; B65D 47/06; B65D 47/2012; B65D 47/2018; B65D 47/24; B65D 47/241; B65D 47/243; B65D 47/28; B65D 47/283; B65D 47/32; B65D 39/0052; B65D 51/16
See application file for complete search history.

(56) References Cited

U.S. PATENT DOCUMENTS 2,913,749 A * 11/1959 Ayres ..... B65D 83/7535 401/196
5,404,901 A * 4/1995 Pickrell ..... B67D 7/0294 137/322
5,413,152 A * 5/1995 Burrows ..... B67D 3/0032 141/18
5,971,221 A * 10/1999 Schwarz ..... B05B 7/2408 222/189.09
5,988,456 A * 11/1999 Laible ..... B67D 7/0294 222/464.1
6,142,345 A * 11/2000 Laible ..... B67D 7/0277 222/189.1
8,083,107 B2 * 12/2011 Laible ..... B65D 47/32 222/189.09
9,126,725 B1 * 9/2015 Laible ..... B65D 25/50
9,242,847 B1 * 1/2016 Laible ..... B67D 7/0294
10,301,088 B1 * 5/2019 Laible ..... B65D 51/16
10,336,517 B1 * 7/2019 Laible ..... B65D 39/0052
10,414,644 B1 * 9/2019 Laible ..... B67D 7/0478
10,414,645 B1 * 9/2019 Laible ..... B65D 47/32
10,508,016 B1 * 12/2019 Laible ..... B67D 7/0277
2010/0213220 A1 * 8/2010 Laible ..... B67D 7/0277 222/481.5

* cited by examiner

*Primary Examiner* — Nicholas J. Weiss
(74) *Attorney, Agent, or Firm* — Dennis L. Thomte; Thomte Patent Law Office LLC

(57) ABSTRACT

A container insert is disclosed for use in a closed loop dispensing system. The insert is press-fitted into the throat of a liquid container. The insert includes a plastic substrate portion and an over-molded portion which is comprised of a TEP material. The container insert is completely recyclable and is automatically self-venting. The insert includes a vertically movable snap-in valve which is movable between an upper closed position and a lower open position. The over-molded portion includes a disc-shaped seal which sealably engages the valve stem of the valve to prevent the upward flow of liquid around the valve when the valve is in either of its closed and open positions.

4 Claims, 10 Drawing Sheets

CONTAINER INSERT FOR USE WITH A CLOSED LOOP DISPENSING SYSTEM

BACKGROUND OF THE INVENTION

Field of the Invention

This invention relates to a container insert for use in a closed loop dispensing system. More particularly, this invention relates to a container insert which is press-fitted into the throat of a liquid container. Even more particularly, this invention relates to a container insert which is completely recyclable. Even more particularly, the container insert of this invention is automatically self-venting. Even more particularly, the container insert of this invention is manufactured by an over-molding process which reduces overall part count and overall assembly time.

Description of the Related Art

Many container inserts have been provided for insertion into the throat of a container containing liquid chemical. Applicant has previously received U.S. Pat. Nos. 10,414,644; 9,242,847; 6,968,983; 6,669,062; 6,142,345 and 5,988,456 wherein inserts have been provided which are inserted into the throat of a liquid container. Applicant's earlier patents represent an advance in closed loop dispensing systems. However, the container inserts of Applicant's earlier patents, except for U.S. Pat. No. 10,414,644 involve considerable parts requiring some assembly time.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A container insert is disclosed for use with a closed loop dispensing system including a container having a throat with an inside surface. The container insert includes a substrate portion having an over-molded portion thereon. The substrate portion includes a horizontally disposed ring-shaped lip having an upper side, a lower side, an outer end and an inner end. The substrate portion also has a generally cylindrical upper wall member having an open upper end, an open lower end, an inner side and an outer side. The upper wall member of the substrate portion extends downwardly from the inner end of the lip whereby the lip protrudes outwardly from the upper end of the upper wall member. The substrate portion also includes a horizontally disposed and generally disc-shaped wall at the lower end of the upper wall member, and which has an inner end, an outer end, an upper side and a lower side. The disc-shaped wall has a plurality of radially spaced-apart vent openings formed therein. The disc-shaped wall of the substrate portion has a central opening formed therein inwardly of the vent openings thereof. The disc-shaped wall of the substrate portion also has a short vertically disposed hollow tube, having a lower end and an upper end, which extends upwardly from the central opening of the disc-shaped wall thereof. The disc-shaped wall of the substrate portion has a plurality of radially spaced-apart arcuate openings or windows formed therein between the vent openings and the short vertically disposed hollow tube thereof. The substrate portion also includes a generally cylindrical lower wall member, having an open upper end and an open lower end, an inner side and an outer side, with the lower wall member extending downwardly from the outer end of the disc-shaped wall. The substrate portion also includes a vertically disposed and cylindrical hollow tube, having upper and lower ends, which is positioned in the lower end of the lower wall member and which is secured thereto.

The over-molded portion of the insert is comprised of a compressible TPE material. The over-molded portion includes an upper ring-shaped portion which embraces the lip of the substrate portion. The over-molded portion also includes a vertically disposed cylindrical wall member which extends downwardly from the upper ring-shaped portion thereof and which embraces the upper wall member of the substrate portion.

The over-molded portion of the insert also includes a horizontally disposed and generally disc-shaped wall which is positioned on the upper side of the disc-shaped wall of the substrate portion. The disc-shaped wall of the over-molded portion has a plurality of radially spaced-apart openings formed therein which register with the vent openings in the disc-shaped wall of the substrate portion. The disc-shaped wall of the over-molded portion has a hollow tubular member, having lower and upper ends, which extends upwardly therefrom. The disc-shaped wall of the over-molded portion has a plurality of hollow protrusions, having upper and lower ends, each of which extends downwardly through one of the radially spaced-apart openings thereof. Each of the protrusions register with one of the vent openings in the disc-shaped wall of the substrate portion. Each of the protrusions has a bi-directional valve at the lower end thereof. The bi-directional valves are normally closed to prevent liquid from passing upwardly therethrough. Each of the bi-directional valves are movable to an open position to permit air to pass downwardly therethrough to vent the container. The upper end of the vertically disposed and cylindrical tube of the substrate portion has a horizontally disposed and ring-shaped seal positioned thereon with the seal having inner and outer ends. The seal is formed by portions of the over-molded material moving downwardly from the disc-shaped wall of the over-molded portion through the radially spaced-apart arcuate openings or windows formed in the disc-shaped wall of the substrate portion to create the horizontally disposed and ring-shaped seal.

The insert of this invention includes a vertically movable and snap-in plastic valve which is movable between an upper closed position and a lower open position. The valve includes a hollow and cylindrical upper valve portion which rests upon the upper end of the hollow tubular member of the over-molded portion. The valve includes a vertically disposed hollow stem, having an open upper end and a lower end, which extends downwardly from the lower end of the upper valve portion into the interior of the hollow tubular member of the over-molded portion. The lower end of the hollow stem portion is closed except for a horizontally disposed bore which extends thereacross. When the valve is in its upper position, the ends of the bore are sealed by the short vertically disposed hollow tube which extends upwardly from the central opening of the disc-shaped wall of the substrate portion. The lower end of the stem has an annular groove formed therein. When the plastic valve is in its upper closed position, the inner end of the seal sealably engages the outer side of the valve stem. When the plastic valve is in its lower open position, the inner end of the seal is sealably received in the annular groove in the stem.

When downward force is applied to the upper end of the upper valve portion, the hollow tubular member of the over-molded portion will be compressed downwardly which enables the valve to move downwardly so that the ends of the bore in the valve stem are in communication with the interior of the vertically disposed and cylindrical hollow tube which is positioned in the lower wall member. In that position, liquid chemical from the container may be drawn upwardly through the hollow tube, upwardly through the hollow valve stem, upwardly through the upper valve member and into a dispenser cap assembly.

It is a principal object of the invention to provide an improved container insert.

A further object of the invention is to provide a container insert which is entirely recyclable.

Yet another object of the invention is to provide an over-molded container insert thereto which is manufactured by an over-molding process which reduces overall part count and overall assembly time.

Yet another object of the invention is to provide a container insert which includes sealing means for preventing liquid from leaking past the plastic valve when the plastic valve is in the upper closed position and when the plastic valve is in the lower open position.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
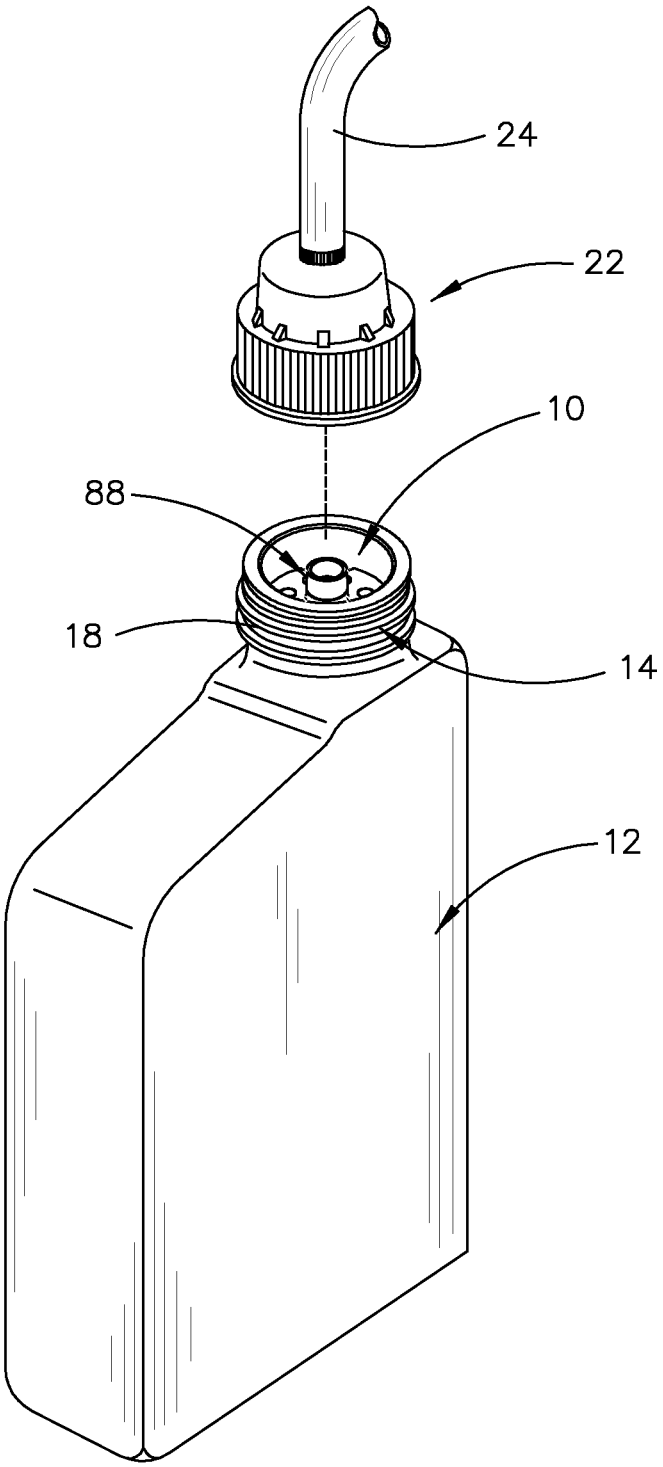
FIG. 1 is a perspective view of a liquid container having the container insert of this invention mounted in the throat of the container and which illustrates a dispenser cap for use with the container.
Figure 2:
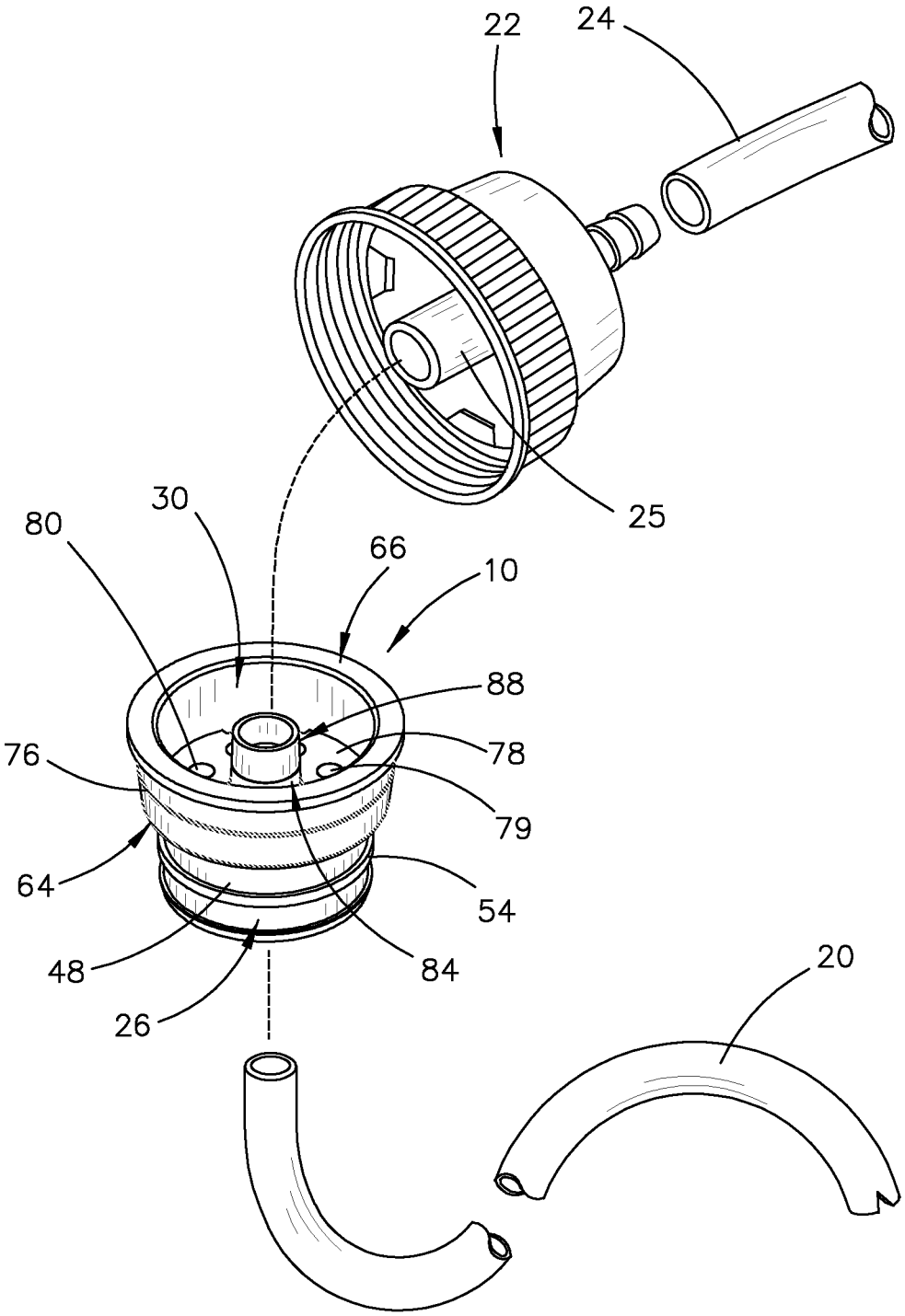
FIG. 2 is an exploded perspective view illustrating the container insert of this invention and associated components.
Figure 3:
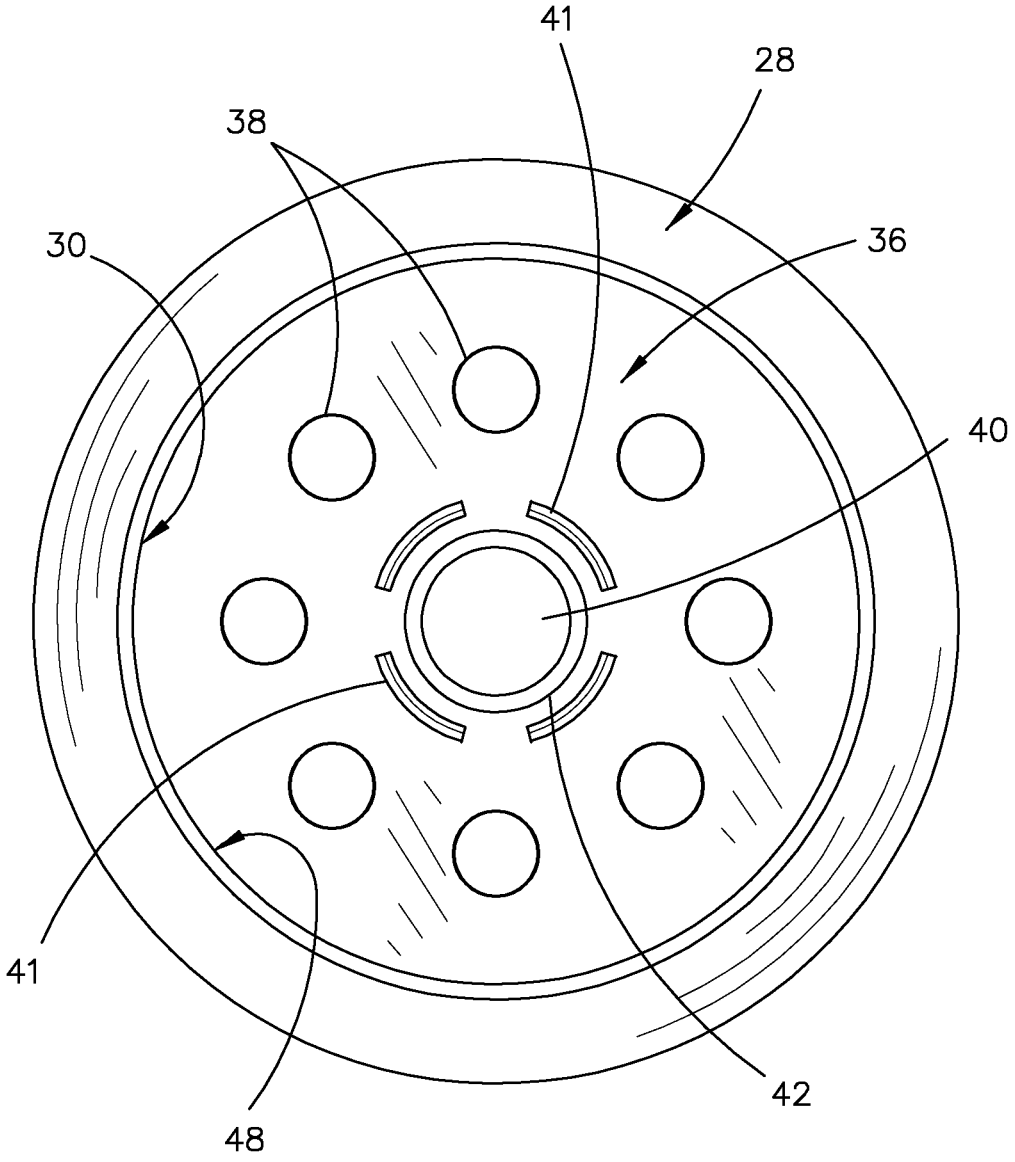
FIG. 3 is a top view of the substrate portion of the container insert of this invention.
Figure 4:
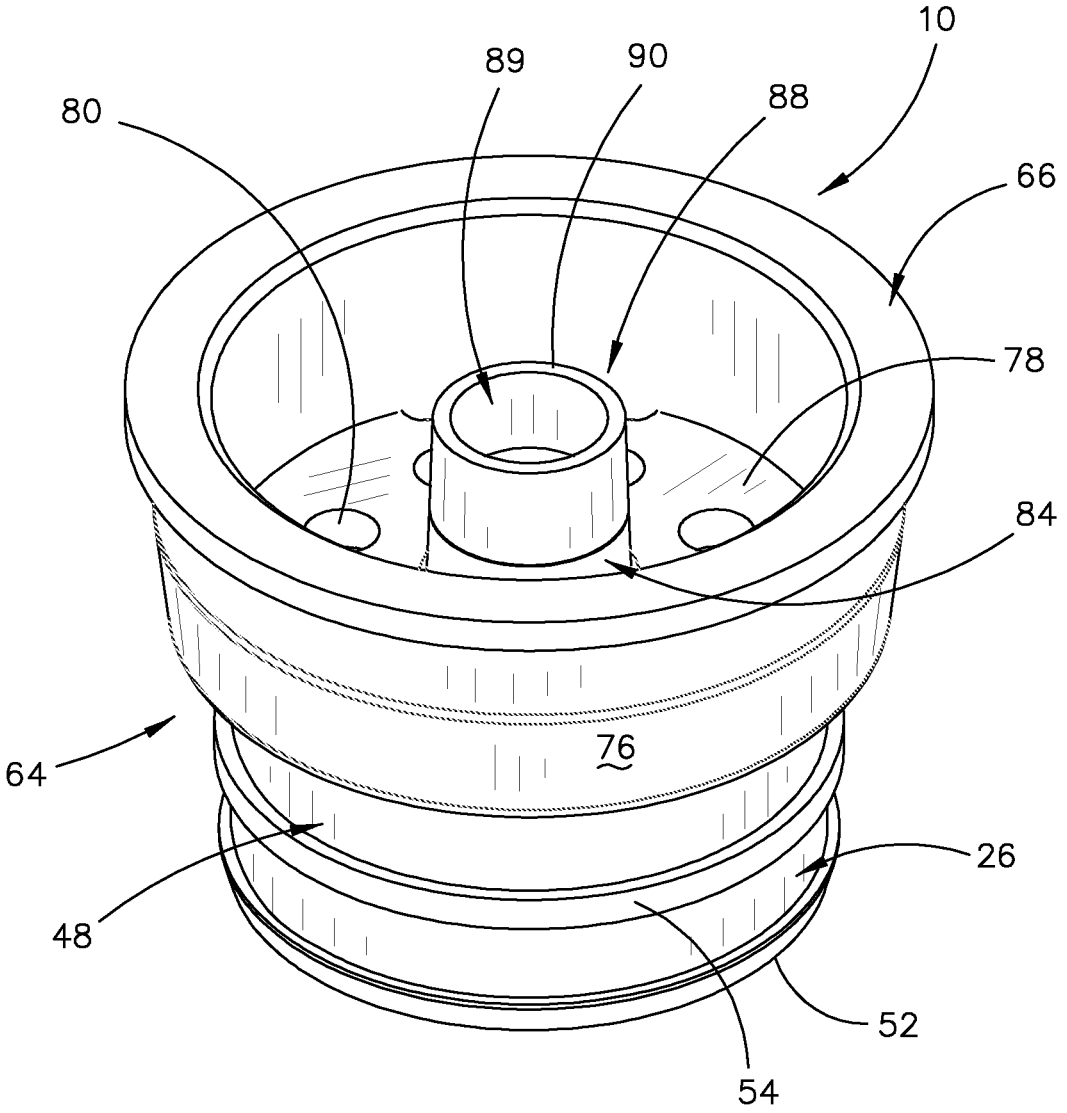
FIG. 4 is an upper perspective view of the container insert of this invention.
Figure 4A:
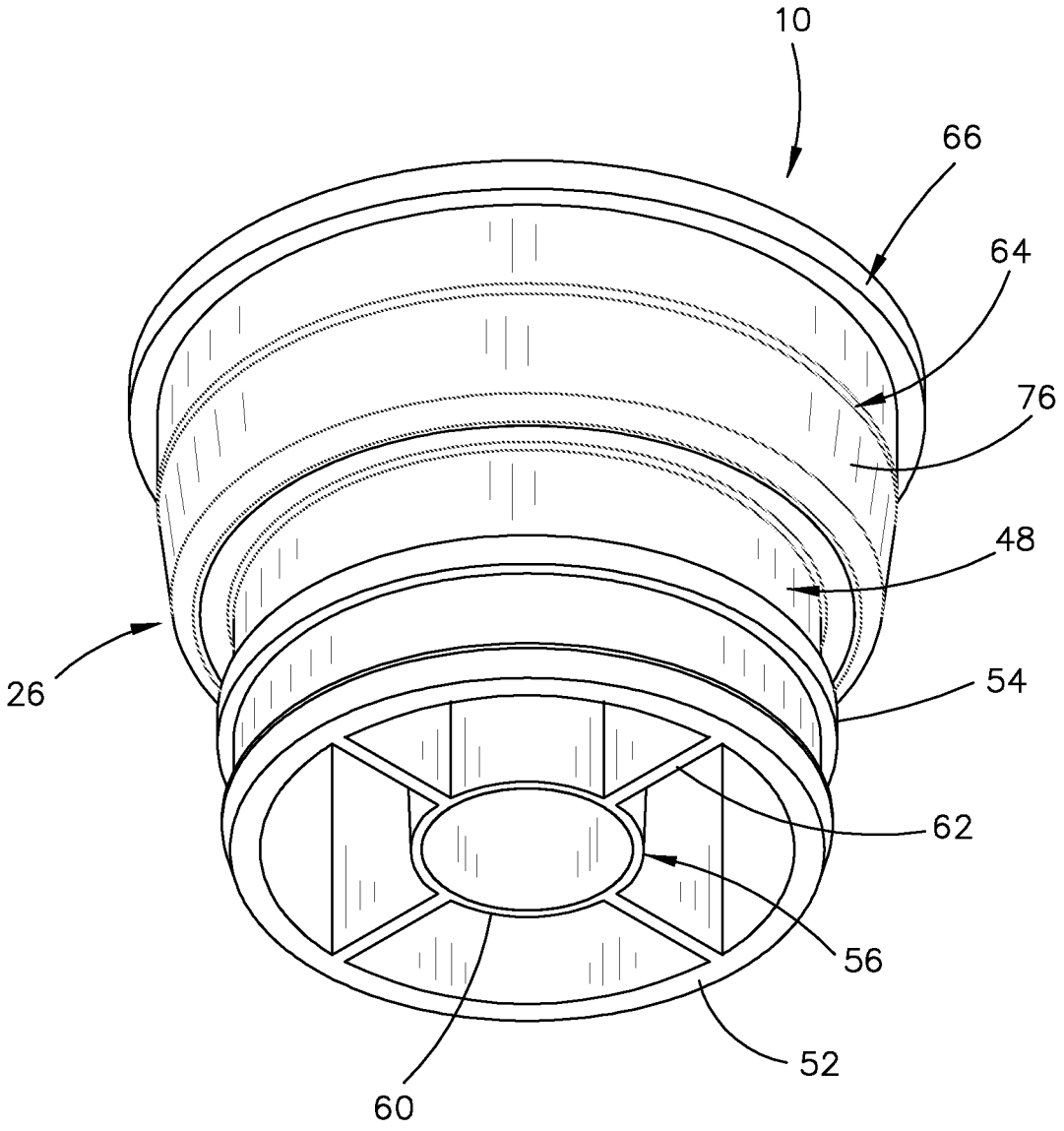
FIG. 4A is a lower perspective view of the container insert of this invention.
Figure 5:
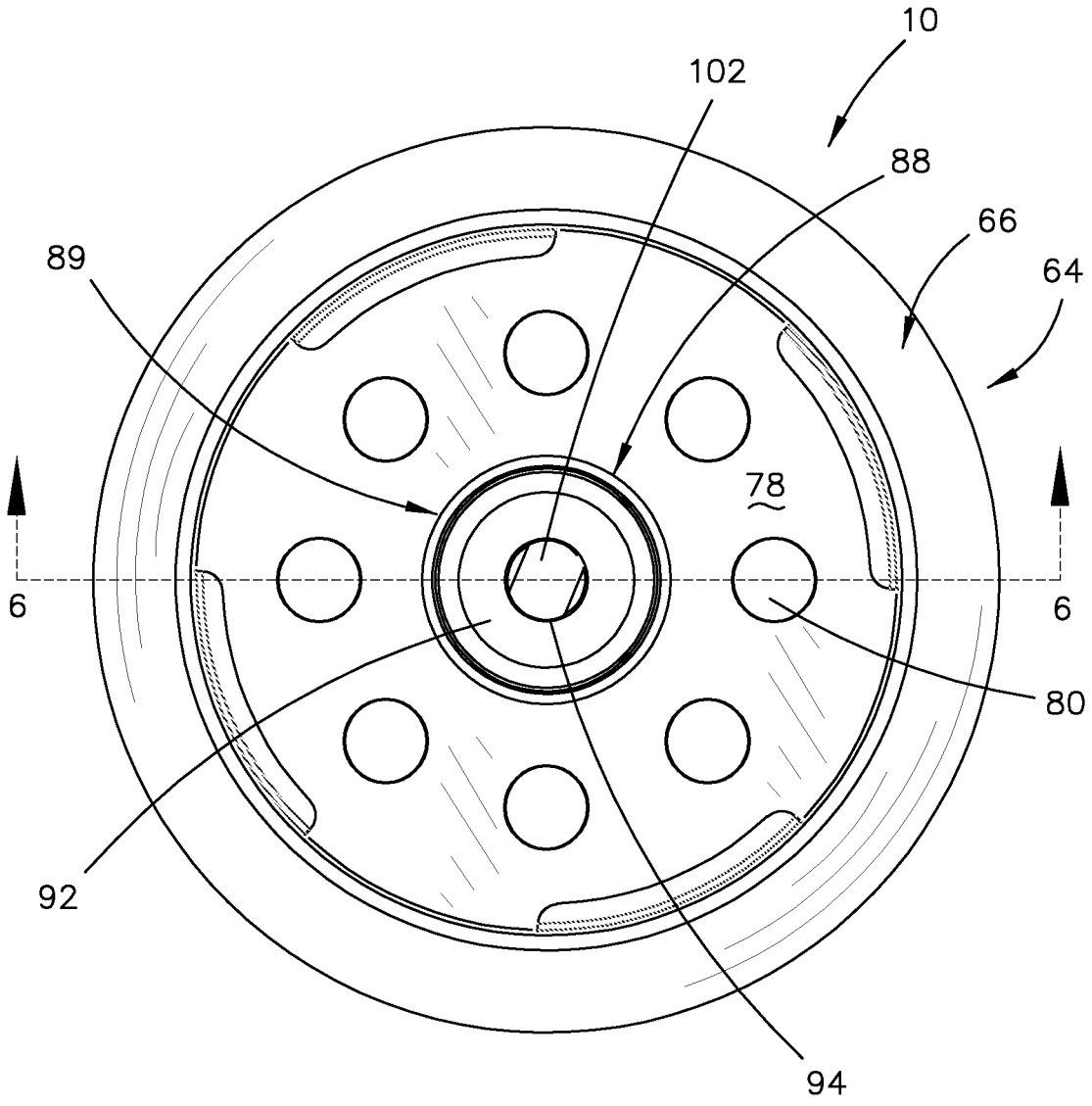
FIG. 5 is a top view of the container insert of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the container insert of this invention which is used in a closed loop dispensing system. The closed loop dispensing system includes a container 12 having a throat 14 at its upper end and which has an inner surface 16 (not shown) and an externally threaded outer surface 18. As will be explained hereinafter, insert 10 is selectively removably positioned in the throat 14 of the container 12 as described in my earlier patents. A dip tube 20 is secured to the lower end of insert 10 as will be described hereinafter. Dip tube 20 extends downwardly into container 12 in conventional fashion. As will be described hereinafter, a dispenser cap assembly 22 may be selectively threadably secured to the externally threaded outer surface 18 of throat 14. As will be described hereinafter, a dispensing tube 24 extends from dispenser cap assembly 22 to a mixing machine, mixer, dispenser, container, etc. as described in my earlier patents. Dispenser cap assembly 22 includes a hollow tube 25 which extends downwardly therefrom and which is in fluid communication with dispensing tube 24.

Insert 10 includes a substrate portion 26 which is comprised of a suitable plastic material. Substrate portion 26 includes a horizontally disposed and ring-shaped lip 28. A generally cylindrical upper wall member 30 extends downwardly from the inner end of lip 28 and has an upper end 32 and a lower end 34. The numeral 36 refers to a horizontally disposed and disc-shaped wall which extends inwardly from the lower end 34 of upper wall member 30. The disc-shaped wall 36 has a plurality of radially spaced-apart vent openings 38 formed therein. Wall member 36 has a central opening 40 formed therein. Wall 36 has a plurality of radially spaced-apart and arcuate openings or windows 41 formed therein which extend downwardly therethrough. Substrate portion 26 also includes a vertically disposed and hollow tube 42, having an upper end 44 and a lower end 46, which extends upwardly from central opening 40. The numeral 48 refers to a hollow cylindrical lower wall member, having an upper end 50 and a lower end 52, which extends downwardly from the lower end 34 of upper wall member 30. The exterior of lower wall member 48 has a plurality of ring-shaped ribs 54 extending therefrom.

Substrate portion 26 also includes a vertically disposed and hollow tube 56, having an upper end 58 and a lower end 60, which extends downwardly from wall member 36 and which is in communication with central opening 40. Substrate portion 26 also includes a plurality of radially spaced-apart and vertically disposed braces or ribs 62 which extend between tube 56 and wall member 48.

The numeral 64 refers to the over-molded portion of the insert 10 which is over-molded onto the substrate portion 26. The over-molded portion 64 is comprised of a TPE material. Over-molded portion 64 includes a horizontally disposed and ring-shaped lip 66 having an inner end 68 and an outer end 70. A vertically disposed and ring-shaped wall 72 extends downwardly from the outer end 70 of lip 66. A short and horizontally disposed wall 74 extends inwardly from the lower end of wall 72. A generally cylindrical and preferably tapered wall 76 extends downwardly from the inner end of wall 74. As seen, lip 28 and wall member 30 of substrate portion 26 are embedded in the over-molded portion 64.

Over-molded portion 64 includes a horizontally disposed and disc-shaped wall 78 which extends inwardly from wall 76 at the lower end thereof, and which is positioned on wall 36. During the over-molding process, as the over-molding TPE forms the disc-shaped wall 76 on the upper side of the disc-shaped wall 36 of substrate 26 some of the over-molding material is forced downwardly from the disc-shaped wall 76 through the arcuate openings or windows 41 formed in wall 36 to create a horizontally disposed and ring-shaped flexible seal 79 on the upper end 58 of hollow tube 56 with the seal 79 having inner and outer ends. The purpose of seal 79 will be discussed in detail hereinafter. Wall 78 has a plurality of radially spaced-apart hollow protrusions 80 formed therewith which extend downwardly into wall 78 into the radially spaced-apart openings 38 formed in wall 36. Protrusions 80 have open upper ends and open lower ends such as disclosed in U.S. Pat. No. 10,414,645 B1. The disclosure of which is incorporated herein by reference thereto to complete this disclosure if necessary. A bi-directional slit-type valve 82 is positioned in each of the lower end of the protrusions 80. The valves 82 are normally closed but will open downwardly to permit venting air to pass downwardly therethrough to vent the container 12. The valves 82 will also open upwardly to permit gas in the container 12 to pass upwardly therethrough. Each of the bi-directional valves 82 are designed so that it takes greater cracking pressure to off-gas the chemical in container 12 than the amount of pressure to let venting air into the container 12. As seen, wall 78 has a vertically disposed and hollow cylindrical and compressible tubular member 84 formed therewith which extends upwardly therefrom and which has an upper end 86 and an open lower end.

Figure 6:
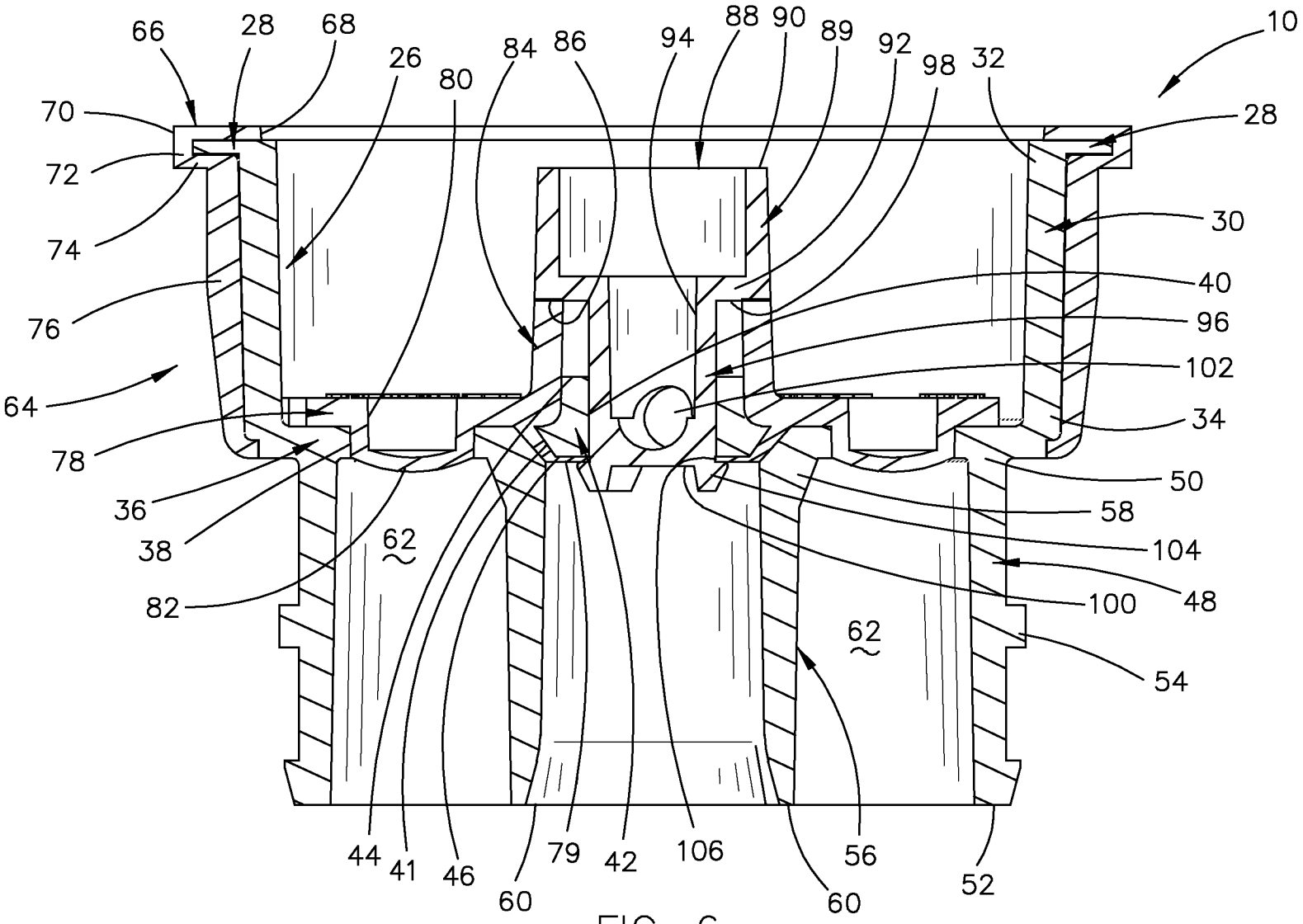
FIG. 6 is a sectional view of the container insert of this invention as seen on lines 6-6 of FIG. 5 with the valve thereof being in a closed position.

The numeral 88 refers to a snap-in plastic valve which includes a hollow cylindrical upper valve member 89 having an upper end 90 and a bottom wall 92 which has an opening 94 formed therein. Valve 88 includes a vertically disposed cylindrical stem 96 which extends downwardly from upper valve member 89 and which has a smaller diameter than upper valve member 89 thereby creating a shoulder 98 at the lower side of bottom wall 92. The lower end 100 of valve stem 96 is closed as seen in the drawings except for the transversely extending bore 102 which extends therethrough. The lower end 100 of valve stem 96 has a ring-shaped and generally V-shaped retainer or stop 104 formed therein. Stem 96 has an annular groove 106 formed therein which extends inwardly into stem 96 above stop 104. As seen in FIG. 6, when valve 88 is in its upper closed position, the inner end of seal 79 is received in annular groove 106 to prevent any liquid in container 12 from leaking upwardly past valve 88. When valve 88 is in its lower open position of FIG. 6A, the inner end of seal 76 sealably engages the exterior surface of stem 96 to prevent any liquid from passing upwardly around valve 88.

In use, the insert 10 will be inserted into the throat 14 of container 12. At that time, valve 88 will be in its upper closed position of FIG. 6. A shipping cap, such as shown in my earlier patents, will be secured to the threads 18 of throat 14 of container 12 when the container 12 is to be shipped. The installation of the shipping cap onto the container 12 does not open the valve 88.

Figure 6A:
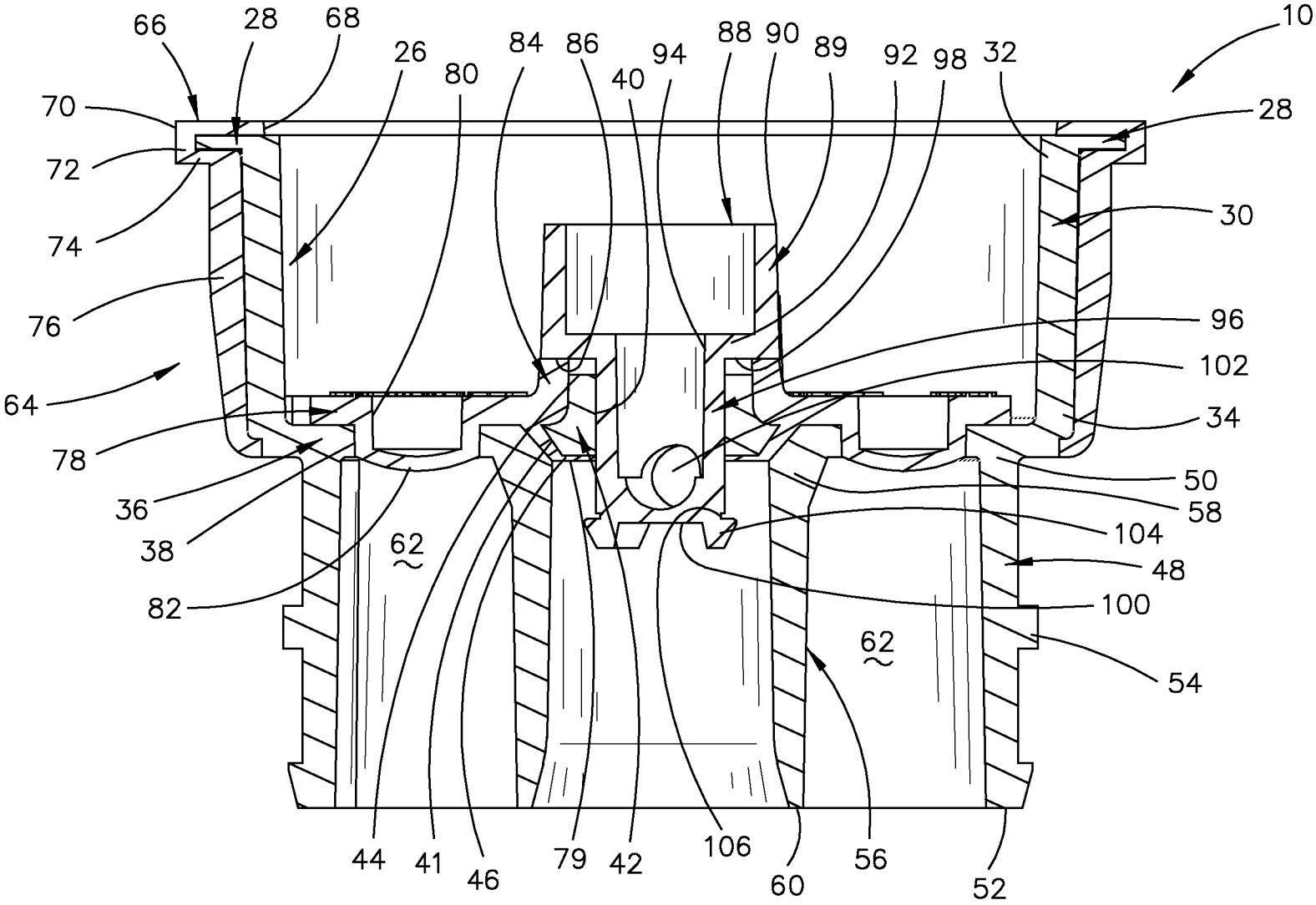
FIG. 6A is a sectional view of the container insert of this invention similar to FIG. 6 except that the valve thereof being in an open position.
Figure 7:
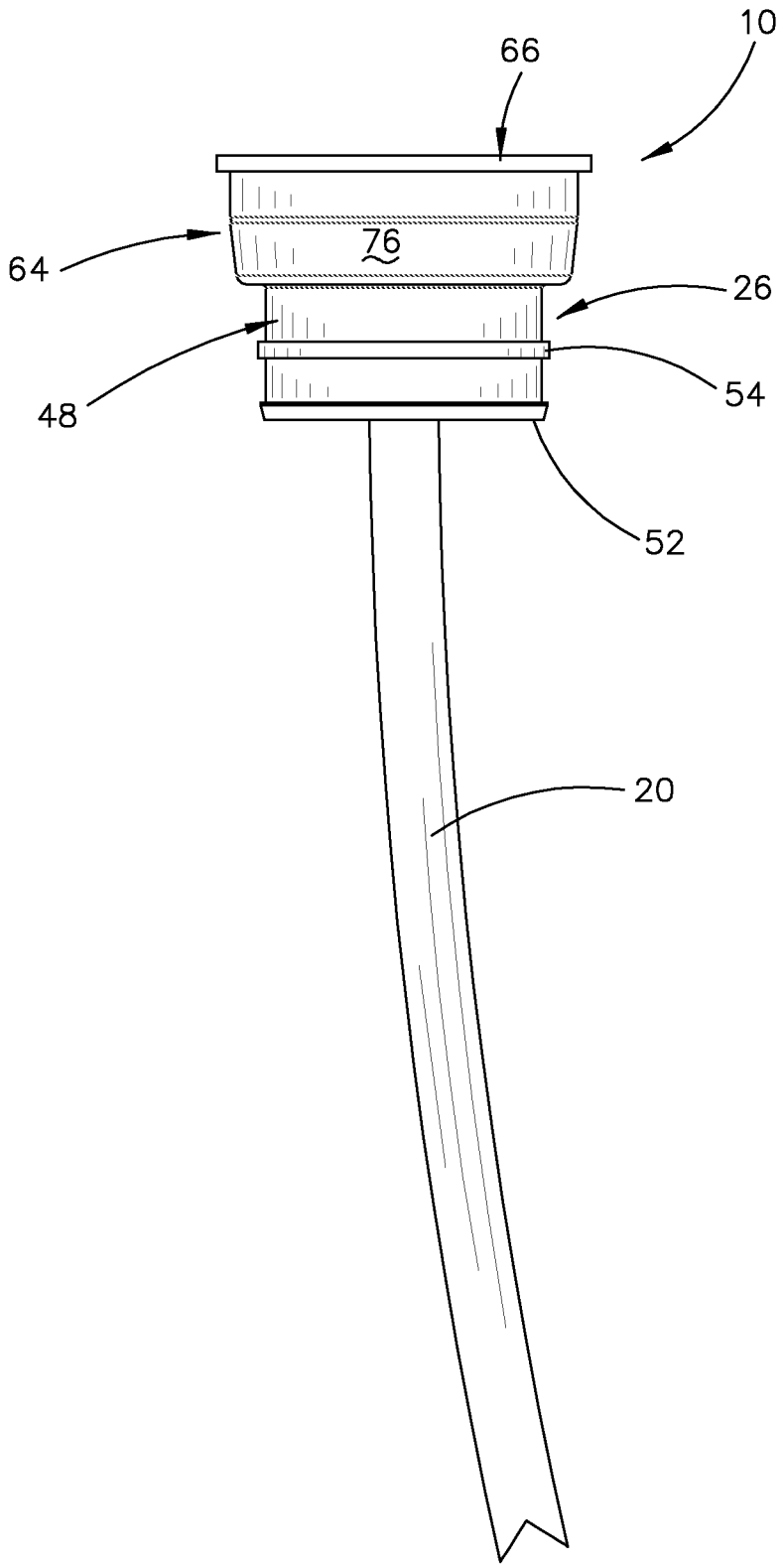
FIG. 7 is a side view of the container insert of this invention which illustrates a dip tube or draw straw extending downwardly therefrom.
Figure 8:
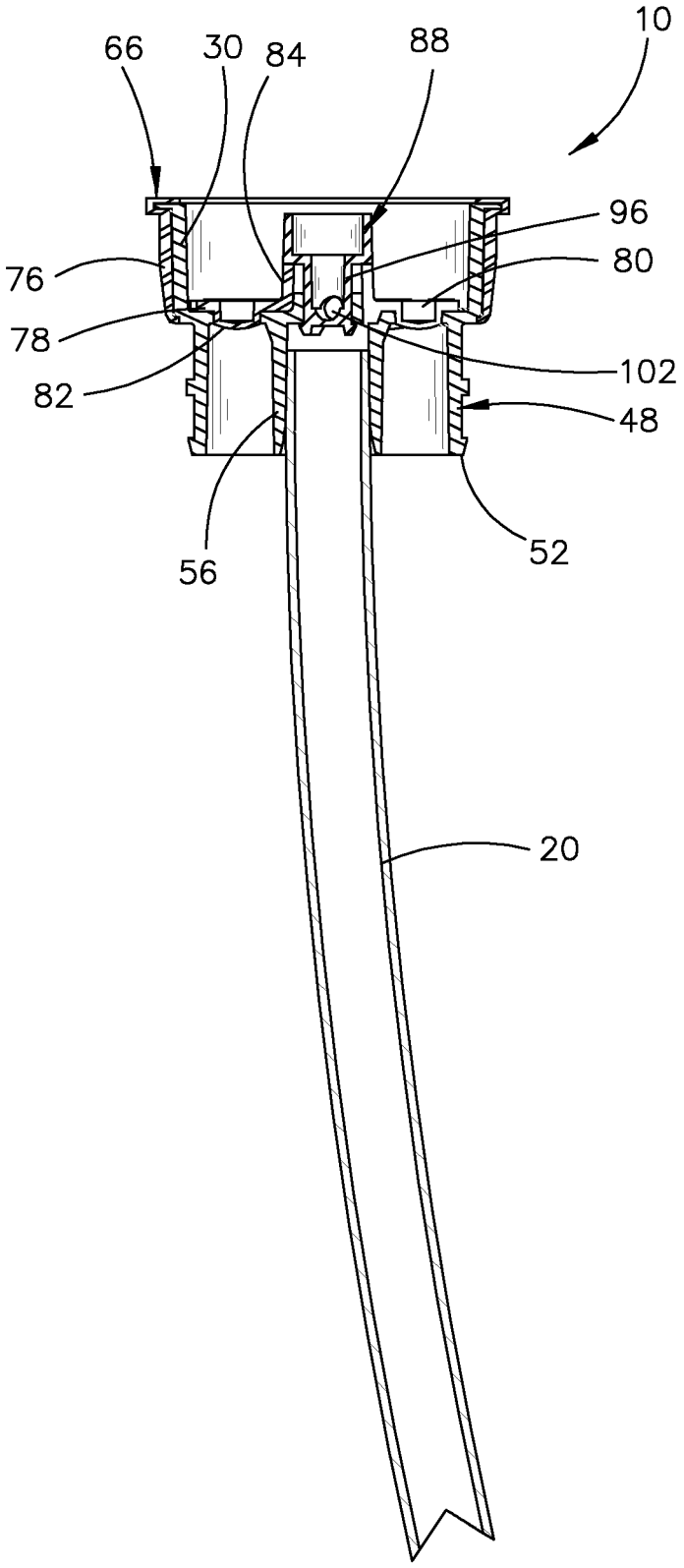
FIG. 8 is a sectional view of FIG. 7.

When it is desired to place the container 12 and the insert 10 into use, the shipping cap will be removed from the container 12. The dispenser cap assembly 22 is then threadably secured to the externally threaded outer surface 18 of throat 14. When dispenser cap assembly 22 is screwed onto the throat 14, the hollow tube 25 of dispenser cap assembly 22 will engage the upper end of upper valve member 89 and move the valve member 89 downwardly which causes the tubular member 84 to compress downwardly so that valve stem 96 will move downwardly until bore 102 communicates with the interior of tube 77 (as seen at FIG. 6A) so that chemical may be drawn upwardly through dip tube 20, through tube 56, through bore 102, into the interior of valve stem 96, through the interior of upper valve member 88, into tube 25 and outwardly through tube 24. The compression of tubular member 84 usually causes a lower portion of tubular member 84 to bulge outwardly somewhat.

As chemical is drawn from the container 12, venting air may be supplied to the interior of container 12 by way of the vent openings 38, protrusions 80 and valves 82. The valves 82 are also able to de-gas the container 12 as described above.

As seen, the entire insert 10 is recyclable. It can also be seen that the over-molding of the insert 10 reduces overall part count and overall assembly time.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A container insert for insertion into the throat of a liquid container of a closed loop dispensing system, comprising:

a plastic substrate portion including:

(a) a horizontally disposed ring-shaped lip having an upper side, a lower side, an outer end and an inner end;

(b) a cylindrical upper wall member having an open upper end, an open lower end, an inner side and an outer side;

(c) said upper wall member extending downwardly from said inner end of said lip whereby said lip protrudes outwardly from said upper end of said upper wall member;

(d) a horizontally disposed and disc-shaped wall at said lower end of said upper wall member having an upper side and a lower side;

(e) said disc-shaped wall having a central opening formed therein;

(f) said disc-shaped wall having a hollow tubular member, having a lower end, an upper end, an inner side and an outer side, extending upwardly therefrom with the interior of said hollow tubular member being in communication with said central opening in said disc-shaped wall;

(g) said disc-shaped wall having a plurality of radially spaced-apart vent openings formed therein outwardly of said hollow tubular member;

(h) a cylindrical lower wall member having an open upper end, an open lower end, an inner side and an outer side;

(i) said lower wall member extending downwardly from said disc-shaped wall inwardly of said lower end of said upper wall member;

(j) a vertically disposed and cylindrical hollow tube, having an open upper end and an open lower end, positioned within said lower wall member and being secured thereto;

(k) said open lower end of said hollow tube being configured to have a dip tube secured thereto with the dip tube being in liquid communication with the container;

an over-molded portion including:

(a) a horizontally disposed and ring-shaped lip positioned on said upper side of said lip of said substrate portion with said lip of said over-molded portion having an inner end and an outer end;

(b) a vertically disposed first wall section, having upper and lower ends, extending downwardly from said outer end of said lip of said over-molded portion outwardly of said lip of said substrate portion;

(c) a horizontally disposed second wall section, having inner and outer ends, extending inwardly from said lower end of said first wall section thereof below said lip of said substrate portion;

(d) a vertically disposed and cylindrical third wall section, having upper and lower ends, extending downwardly from said inner end of said second wall section at said outer side of said upper wall member of said substrate portion;

(e) a horizontally disposed and disc-shaped wall at said lower end of said cylindrical third wall section of said over-molded portion;

(f) said disc-shaped wall of said over-molded portion being positioned on said disc-shaped wall of said substrate portion;

(g) said disc-shaped wall of said over-molded portion having a vertically disposed and vertically compressible hollow tube, having upper and lower ends, extending upwardly from the center of said disc-shaped wall of said over-molded portion;

(h) said disc-shaped wall of said over-molded portion having a plurality of radially spaced-apart openings formed therein which register with said radially spaced-apart openings formed in said disc-shaped wall of said substrate portion;

(i) a hollow protrusion, having upper and lower ends, extending downwardly from each of said plurality of spaced-apart openings in said disc-shaped wall of said over-molded portion through a registering opening of said plurality of radially spaced-apart openings in said disc-shaped wall of said substrate portion;

(j) said over-molded portion being comprised of a compressible TPE material;

each of said protrusions having a bi-directional valve at said lower end thereof;

each of said bi-directional valves being normally closed to prevent liquid from passing upwardly therethrough;

each of said bi-directional valves being movable to an open position to permit air to pass downwardly therethrough to vent the container;

a vertically movable plastic valve which is movable between a closed upper position and an open lower position and which includes:

(a) a hollow and cylindrical upper valve portion having an upper end, a bottom wall which has a central opening formed therein which has a smaller diameter than an open upper end of said upper end of said upper valve portion;

(b) a vertically disposed and elongated valve stem having an open upper end which communicates with said central opening of said upper valve portion, a closed lower end, a transversely extending and horizontally disposed bore which is formed in said valve stem at said lower end thereof which extends therethrough and which communicates with the interior of said valve stem;

(c) said bottom wall of said upper valve portion resting on said upper end of said hollow tubular member of said disc-shaped wall of said over-molded portion, with said valve stem extending downwardly through said hollow tubular member of said over-molded portion and slidably extending downwardly through said tubular member of said disc-shaped wall of said substrate portion;

(d) said bore being closed by said vertically disposed hollow tube of said disc-shaped wall of said substrate portion when said plastic valve is in said closed upper position;

(e) said bore being open and in communication with the interior of said hollow tube which is positioned within said lower wall member when said plastic valve is in said lower open position;

(f) said compressible hollow tube of said disc-shaped wall of said over-molded portion yieldably maintaining said plastic valve in said upper closed position; and (g) said plastic valve compressibly moving said compressible hollow tube of said disc-shaped wall of said over-molded portion downwardly upon downward force being applied to said plastic valve thereby moving said stem and said bore therein downwardly so that said bore will be in communication with the interior of said hollow tube positioned within said lower wall member of said substrate portion thereby permitting liquid from said container to be drawn upwardly through said dip tube, through said hollow tube positioned within said lower member of said substrate portion, inwardly into said bore, upwardly through said plastic valve and outwardly from the container insert.

2. A container insert for insertion into the throat of a liquid container of a closed loop dispensing system, comprising:

a plastic substrate portion including:

(a) a horizontally disposed ring-shaped lip having an upper side, a lower side, an outer end and an inner end;

(b) a cylindrical upper wall member having an open upper end, an open lower end, an inner side and an outer side;

(c) said upper wall member extending downwardly from said inner end of said lip whereby said lip protrudes outwardly from said upper end of said upper wall member;

(d) a horizontally disposed and disc-shaped wall at said lower end of said upper wall member having an upper side and a lower side;

(e) said disc-shaped wall having a central opening formed therein;

(f) said disc-shaped wall having a hollow tubular member, having a lower end, an upper end, an inner side and an outer side, extending upwardly therefrom with the interior of said hollow tubular member being in communication with said central opening in said disc-shaped wall;

(g) said disc-shaped wall having a plurality of radially spaced-apart vent openings formed therein outwardly of said hollow tubular member;

(h) a cylindrical lower wall member having an open upper end, an open lower end, an inner side and an outer side;

(i) said lower wall member extending downwardly from said disc-shaped wall inwardly of said lower end of said upper wall member;

(j) a vertically disposed and cylindrical hollow tube, having an open upper end and an open lower end, positioned within said lower wall member and being secured thereto;

(k) said open lower end of said hollow tube being configured to have a dip tube secured thereto with the dip tube being in liquid communication with the container;

an over-molded portion including:

(a) a horizontally disposed and ring-shaped lip positioned on said upper side of said lip of said substrate portion with said lip of said over-molded portion having an inner end and an outer end;

(b) a vertically disposed first wall section, having upper and lower ends, extending downwardly from said outer end of said lip of said over-molded portion outwardly of said lip of said substrate portion;

(c) a horizontally disposed second wall section, having inner and outer ends, extending inwardly from said lower end of said first wall section thereof below said lip of said substrate portion;

(d) a vertically disposed and cylindrical third wall section, having upper and lower ends, extending downwardly from said inner end of said second wall section at said outer side of said upper wall member of said substrate portion;

(e) a horizontally disposed and disc-shaped wall at said lower end of said cylindrical third wall section of said over-molded portion;

(f) said disc-shaped wall of said over-molded portion being positioned on said disc-shaped wall of said substrate portion;

(g) a horizontally disposed and disc-shaped seal, having an inner end, an outer end, an upper side and a lower side, positioned on said upper end of said cylindrical hollow tube of said substrate portion so as to extend inwardly therefrom;

(h) said disc-shaped wall of said over-molded portion having a vertically disposed and vertically compressible hollow tube, having upper and lower ends, extending upwardly from the center of said disc-shaped wall of said over-molded portion;

(i) said disc-shaped wall of said over-molded portion having a plurality of radially spaced-apart openings formed therein which register with said radially spaced-apart openings formed in said disc-shaped wall of said substrate portion;

(j) a hollow protrusion, having upper and lower ends, extending downwardly from each of said plurality of spaced-apart openings in said disc-shaped wall of said over-molded portion through a registering opening of said plurality of radially spaced-apart openings in said disc-shaped wall of said substrate portion;

(k) said over-molded portion being comprised of a compressible TPE material;

each of said protrusions having a bi-directional valve at said lower end thereof;

each of said bi-directional valves being normally closed to prevent liquid from passing upwardly therethrough;

each of said bi-directional valves being movable to an open position to permit air to pass downwardly therethrough to vent the container;

a vertically movable plastic valve which is movable between a closed upper position to an open lower position and which includes:

(a) a hollow and cylindrical upper valve portion having an upper end, a bottom wall which has a central opening formed therein which has a smaller diameter than an open upper end of said upper end of said upper valve portion;

(b) a vertically disposed and elongated valve stem having an open upper end which communicates with said central opening of said upper valve portion, a closed lower end, a transversely extending and horizontally disposed bore which is formed in said valve stem at said lower end thereof which extends therethrough and which communicates with the interior of said valve stem;

(c) said inner end of said horizontally disposed and disc-shaped seal being in sealable engagement with said valve stem when said plastic valve is in said open lower position;

(d) said bottom wall of said upper valve portion resting on said upper end of said hollow tubular member of said disc-shaped wall of said over-molded portion, with said valve stem extending downwardly through said hollow tubular member of said over-molded portion and slidably extending downwardly through said tubular member of said disc-shaped wall of said substrate portion;

(e) said bore being closed by said vertically disposed hollow tube of said disc-shaped wall of said substrate portion when said plastic valve is in said closed upper position;

(f) said bore being open and in communication with the interior of said hollow tube which is positioned within said lower wall member when said plastic valve is in said lower open position;

(g) said compressible hollow tube of said disc-shaped wall of said over-molded portion yieldably maintaining said plastic valve in said upper closed position; and (h) said plastic valve compressibly moving said compressible hollow tube of said disc-shaped wall of said over-molded portion downwardly upon downward force being applied to said plastic valve thereby moving said stem and said bore therein downwardly so that said bore will be in communication with the interior of said hollow tube positioned within said lower wall member of said substrate portion thereby permitting liquid from said container to be drawn upwardly through said dip tube, through said hollow tube positioned within said lower member of said substrate portion, inwardly into said bore, upwardly through said plastic valve and outwardly from the container insert.

3. The container insert of claim 2 wherein said valve stem has an annular groove formed therein at said lower end thereof and wherein said inner end of said horizontally disposed and disc-shaped seal is sealably received in said annular groove when said plastic valve is in said upper closed position.

4. The container insert of claim 2 wherein said horizontally disposed and disc-shaped seal sealably embraces said valve stem when said plastic valve is in said lower open position.

* * * * *